United States Patent [19]

Beduz et al.

[11] Patent Number: 5,014,773

[45] Date of Patent: May 14, 1991

[54] LIQUEFIED GAS BOILERS

[75] Inventors: Carlo Beduz; Ralph G. Scurlock, both of Southampton, England

[73] Assignee: The BOC Group plc, Windlesham, England

[21] Appl. No.: 232,394

[22] Filed: Aug. 12, 1988

[30] Foreign Application Priority Data

Aug. 14, 1987 [GB] United Kingdom ..... 8719349

[51] Int. Cl.[5] ..... F28D 5/02

[52] U.S. Cl. ..... 165/115; 165/914

[58] Field of Search ..... 165/115, 110, 914

[56] References Cited

U.S. PATENT DOCUMENTS

| | | | |
|---|---|---|---|
| 2,668,424 | 2/1954 | Mueller | 165/118 X |
| 3,371,709 | 3/1958 | Rosenblad | 165/115 |
| 3,587,730 | 6/1971 | Milton . | |
| 4,572,287 | 2/1986 | Allo et al. | 165/118 |
| 4,715,433 | 12/1987 | Schwartz et al. . | |

FOREIGN PATENT DOCUMENTS

| | | | |
|---|---|---|---|
| 0130122 | 2/1985 | European Pat. Off. . | |
| 745347 | 5/1943 | Fed. Rep. of Germany . | |
| 1511013 | 12/1967 | France . | |
| 1388733 | 3/1975 | United Kingdom . | |
| 2120770A | 12/1983 | United Kingdom | 165/115 |

*Primary Examiner*—Allen J. Flanigan

*Attorney, Agent, or Firm*—Carol A. Nemetz; Robert I. Pearlman

[57] ABSTRACT

An improved boiler for liquefied gases comprises at least one heat transfer surface having means for creating a falling film of liquefied gas from its upper to lower end and means to heat the surface above the temperature at which the liquefied gas boils at the prevailing pressure. The subject apparatus is particularly suited for reboiling liquid nitrogen or liquid oxygen.

4 Claims, 4 Drawing Sheets

2
4
6
8
10
12
14
22
II 14
18
20

14
18
20
4 x500 x5000

LIQUEFIED GAS BOILERS

BACKGROUND OF THE INVENTION

This invention relates to liquefied gas boilers and to methods of boiling liquefied gas, i.e., as defined herein, the liquid phase of a substance which has a boiling point of 20° or below at 1 atmosphere absolute. More particularly, this invention relates to condenser-reboilers for use in association with air separation columns.

In a conventional double column for the separation of air (from which constituents of relatively low volatility such as carbon dioxide and water vapor have been removed) the lower column is operated at a relatively elevated pressure in comparison with the upper column. A condenser-reboiler condenses nitrogen vapor at the top of the lower column and reboils liquid oxygen at the bottom of the upper column. The condenser-reboiler thus provides a thermal link between the two columns, and in effect, given a predetermined operating pressure at the bottom of the upper column, determines the operating pressure and the temperature at the top of the lower column. In order to provide the necessary thermal energy to reboil the liquid oxygen, it is necessary that the nitrogen condense at a higher temperature than that of the boiling point of the liquid oxygen. The more efficient the heat exchange between the condensing nitrogen and the boiling liquid oxygen, the less the temperature difference between the two fluids in the condenser reboiler needs to be, and hence the lower the temperature and pressure at which the nitrogen condenses. Moreover, as a consequence of more efficient heat exchange and lower operating pressure in the lower column, less work need be done in compressing the air to the operating pressure of the lower column. Alternatively, the advantage of more efficient heat exchange can be reaped in employing a smaller condenser-reboiler.

The temperature difference between the temperature of the heated wall and the boiling liquid oxygen is defined by the quantity Q/hA where Q/A is the heat flux or heat flow per unit area absorbed in boiling the liquefied gas, A is the nominal surface area of the surface at which the liquefied gas is boiled and h is a quantity known as the boiling heat transfer co-efficient. Accordingly, for given values of Q and A, the temperature difference decreases with increases in the boiling heat transfer co-efficient. There are many proposals in the art for increasing the boiling heat transfer co-efficient of heat exchanger and condenser-reboiler surfaces by providing such surfaces with nucleation sites for the formation of vapor bubbles. Methods of forming such nucleation sites typically involve working the surface to provide cavities or channels therein, or providing a surface with a porous coating. Examples, of such improved boiling surfaces are given in, for example, U.S. Pat. Nos. 3,384,154, 3,457,990 and Re-issue 30,077 and U.K. Patent Application No. 2 155 612 A.

In conventional condenser-reboilers, flow of liquid oxygen through its respective exchange passages is by virtue of the head of liquid oxygen in which the condenser-reboiler is partially or totally immersed. In practice, a rise in the local boiling temperature is associated with the head of liquid oxygen, the boiling temperature rising from 0.5 to 1 degree K per metre depth of liquid. We have discovered that the boiling heat transfer coefficient of a heat transfer surface is increased by forming a falling film of liquefied gas over the heat transfer surface. We have also found that the boiling heat transfer coefficient is further increased when the heat transfer surface has a multitude of nucleation sites for the formation of vapor bubbles.

SUMMARY OF THE INVENTION

According to the present invention, there is provided a boiler for liquefied gas comprising at least one heat transfer surface having an upper and a lower end, means for creating a falling film of liquefied gas down said surface, and means for heating the surface above the temperature at which the liquefied gas boils at the prevailing pressure. The subject apparatus is particularly suitable for use in reboiling liquid oxygen or liquid nitrogen.

BRIEF DESCRIPTION OF THE DRAWINGS

FIGS. 1–4 are not to scale.

DETAILED DESCRIPTION OF THE INVENTION

Figure 1:
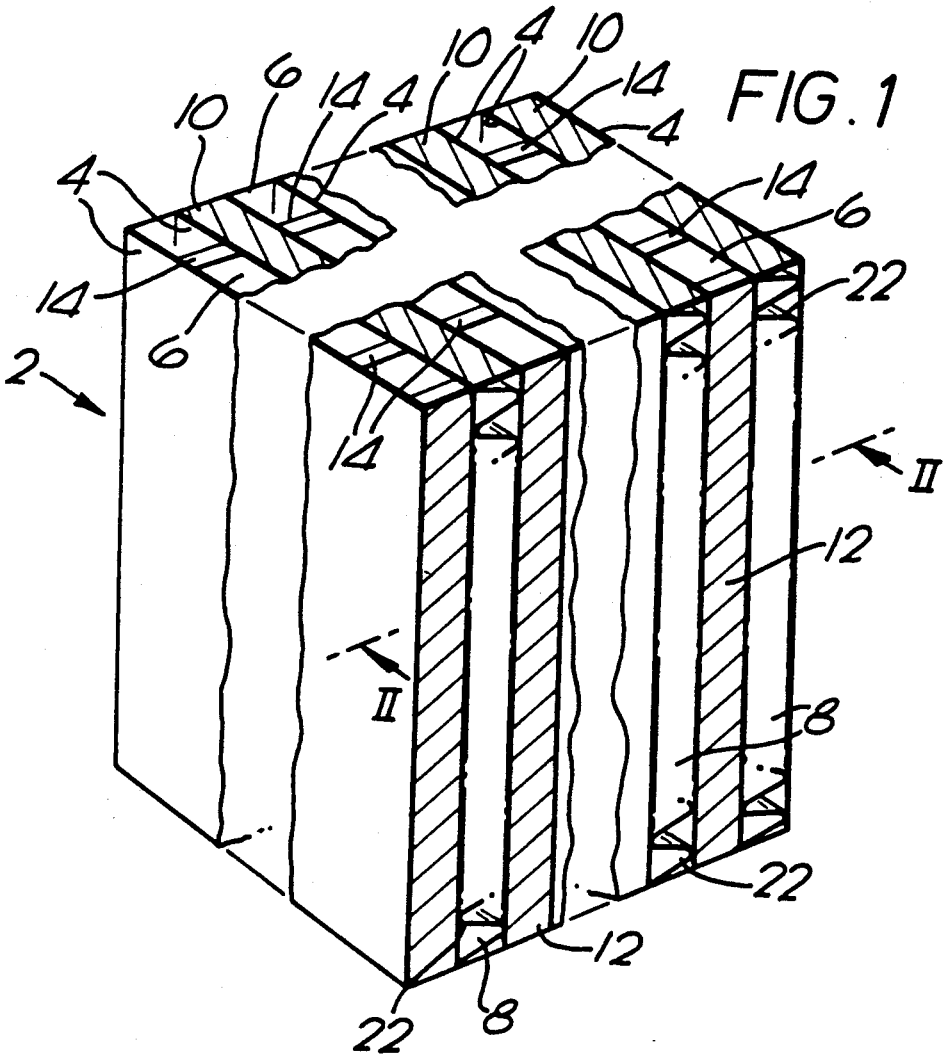
FIG. 1 is a schematic perspective drawing of a condenser-reboiler according to the invention.

The present invention provides a boiler for liquefied gas, comprising at least one heat transfer surface having an upper end and a lower end and having on the surface a falling film of liquefied gas. The surface is heated above the temperature at which the liquefied gas boils at the prevailing pressure. The heat transfer surface is preferably heated by a condensing vapor or by a liquefied gas being sub-cooled. Thus, for example, liquid oxygen may be reboiled by condensing nitrogen vapor or liquid nitrogen is vaporized by a separate flow of liquid nitrogen being sub-cooled.

The falling film of liquefied gas is preferably created by spraying the liquefied gas onto the surface. Preferably, the vapor evolved by the boiling liquefied gas is constrained to flow in the some general direction as the liquefied gas. Thus, in the example of a reboiler, condenser, the boiling passages are preferably closed at their upper ends so that vapor can exit only from the bottom thereof. Also, the passages for the boiling of the liquefied gas are preferably arranged alternatively with passages for the condensation of another liquefied gas.

Each said heat transfer surface of the subject boiler preferably comprises a metal or alloy of relatively high thermal conductivity, such as copper, aluminum or their alloys. The surface may be provided with cavities, indentations, scratches, or other irregularities which provide nucleation sites for the formation of vapor bubbles. Preferably, the nucleation sites are provided by a porous metallic coating. A porous coating also encourages a homogeneous distribution of film of liquefied gas on the surface. The coating may be of the same or different composition as the surface to which it is applied. Typically, the coating is selected from aluminum, copper, and their alloys. Preferably, the coating is formed by depositing a mixture of particles of the desired metal and particles of a suitable plastic material or particles of a composite of metal and plastics material onto the heat exchange surface to form a coating comprising particles of plastics material embedded in metal. The resulting coating is then heated to volatize the plastic material, thereby removing it and leaving a porous metal coating including a multitude of irregular, interconnected, re-entrant cavities. The plastics-metallic coating may be deposited by flame spraying or, preferably, plasma spraying.

The average size of the plastics particles in the mixture deposited onto the heat exchange surface is in the range of about 15 to 150 microns. Typically, the mass of metal particles to plastics particles in the mixture is from about 4:1 to 1:1. Since the metal has a greater density than the plastics, the resulting coating will have a porosity of from 20 to 60% and typically has a surface comprising a network of open re-entrant pores or cavities having an average size of from about 15 to 150 microns, more typically from about 15 to 50 microns. The plastics particles may be selected from a large group of polymeric materials. Suitable plastics materials must vaporize at temperatures of at least 500° C. and typically from about 500° to 600° C. without leaving a carbonaceous or other residue. A preferred material is polyester. Utilizing a polyester- containing mixture, the coating is heated to a temperature of from about 500° to 600° C. to effect removal of the deposited polyester.

One embodiment of a boiler according to the present invention includes a plurality of spaced apart, parallel, thermally conductive plates defining, respectively, alternating passages for liquefied gas being boiled and for a fluid which heats the heat transfer surfaces present on the boiling side of the conductive plates. Each liquefied gas passage preferably has a plurality of cooperating spacer members dividing said passage into a plurality of vertical channels. Each spacer member typically has formed therein a plurality of spray orifices in communication with a source of the liquefied gas. The number and positioning of the orifices is chosen so as to facilitate the creation of a thin falling film of liquefied gas to be boiled down the associated heat transfer surface or surfaces. If desired, the orifices may be provided only in top regions of their associated channels. It should be noted that the term "vertical" as utilized herein is not restricted to the absolute vertical. It is intended that the heat transfer surface of the subject boilers be sufficiently vertical to obtain a free falling film of liquefied gas.

The heat exchange surfaces in the passages for boiling the liquefied gas are preferably coated with a porous metal layer as described above. Such a coating may present difficulties in bonding other structures thereto. Therefore, during deposition of the porous metal coating, those portions of the heat exchange surfaces that are to be bonded or otherwise joined to other structures such as spray bars, are masked so as to leave suitable surfaces for bonding such structures thereto. For this reason, the boiling passages of the subject structures are preferably not provided with fins to increase available surface. The passages for the heating fluids, which do not have the porous metal coating, are preferably provided with fins.

Fabrication of the boiler structures of the present invention may be carried out by known methods. For example, the plates can be joined to the spray bars and such spacer bars as are necessary by vacuum brazing. In the event that the porous metal surface is a metal such as aluminum or an alloy thereof, temperatures conventionally used in vacuum brazing or diffusion bonding thereof may be employed.

The drawings illustrate a single preferred embodiment of the present invention only, and other variations falling within the scope of the appended claims will undoubtedly occur to those skilled in the art.

Referring to the drawings, the illustrated condenser-reboiler in FIG. 1 is in the form of a parallel plate heat exchanger 2 comprising a plurality of parallel heat exchange change plates 4 spaced uniformly apart. The plates 4 define a set of boiling passages 6 for boiling a liquefied gas spaced alternately with a set of condensing passages 8 for condensing vapor of a different gas. In order to facilitate headering for the condenser-reboiler, each of the condensing passages 8 is provided with horizontal spacer bars 10 at its top and its bottom (only the top spacer bars are shown in FIG. 1) and each of the boiling passages 6 is provided with vertical spacer bars 12 closing the sides thereof (see FIG. 2). In FIG. 1, the spacer bars 10 and 12 are indicated by cross-hatching. Accordingly, vaporized gas, with any residual liquid, may be withdrawn from the bottom portion of the boiling passages 6 (the tops thereof preferably being closed so as to constrain vapor to flow downwards) while flow of condensing vapor through the condensing passages 8 may be from side-to-side of the condenser-reboiler (as shown in FIG. 1).

Figure 3A:
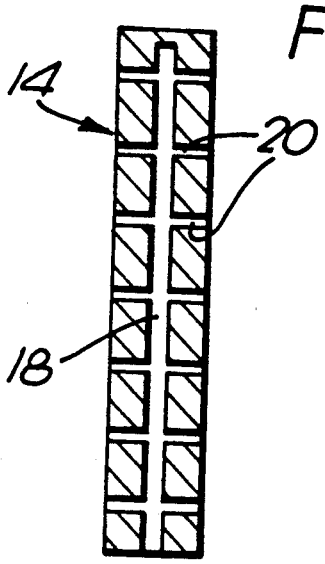
FIG. 3A is a schematic sectional elevation of a spray bar employed in the condenser-reboiler shown in FIGS. 1 and 2.
Figure 3B:
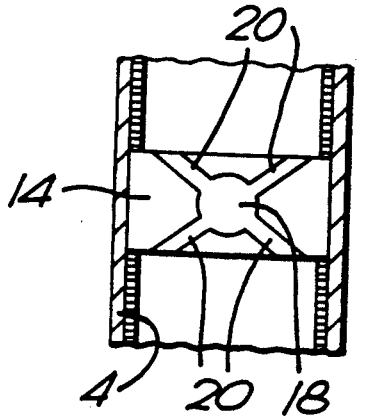
FIG. 3B is a schematic cross section of spray bar 14.
Figure 2:
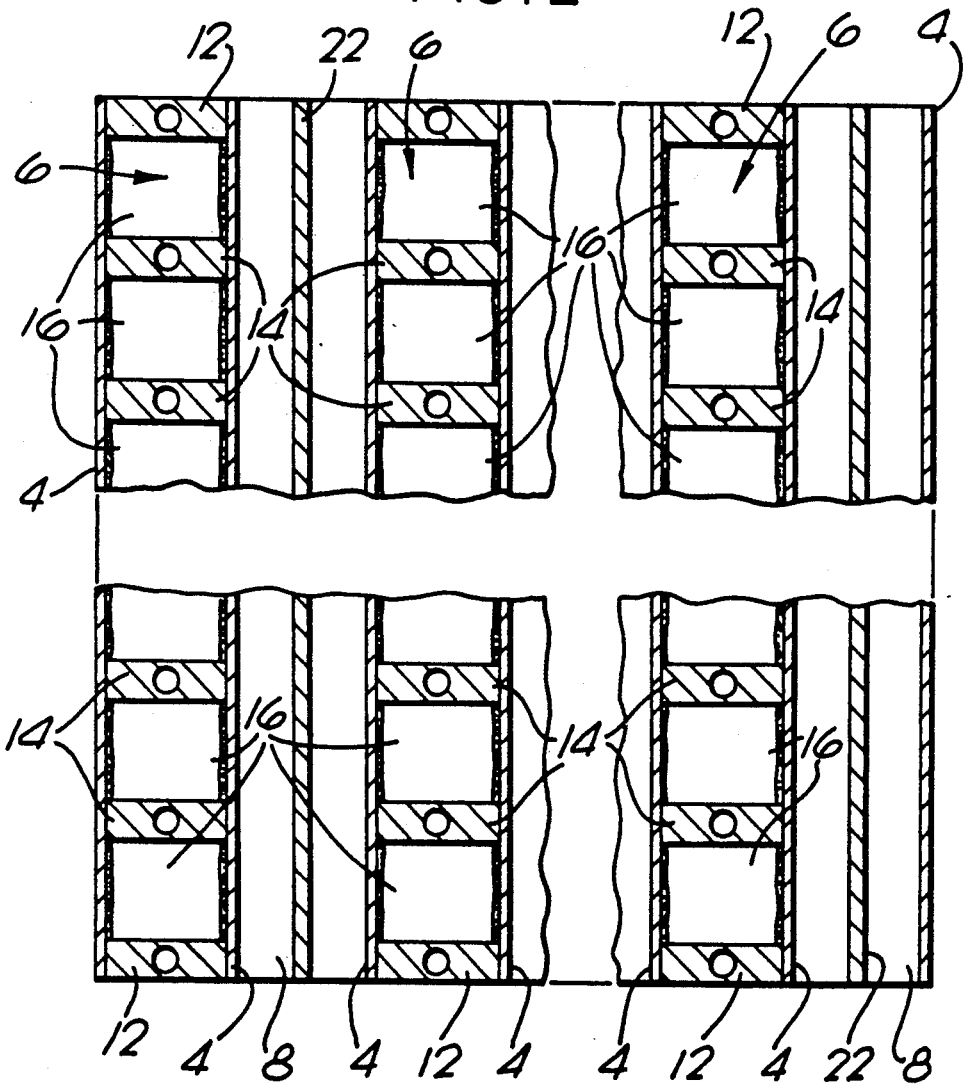
FIG. 2 is a schematic section through the line II—II in FIG. 1

Each boiling passage 6 for vaporizing liquid gas has a plurality of equally spaced vertical spray bars 14 which run from top to bottom of the condenser-reboiler, which are bonded to the plates defining the passages 6 and which sub-divide each such passage into vertical channels 16 (see FIG. 2). Those plate surfaces defining the channels 16 are each provided with a coating of porous aluminum or other heat conductive metal or are otherwise provided with nucleation sites. The spacer bars 10 and 12 and the spray bars 14 are of the same metal as the plates 4. The spacer bars 12 and the spray bars 14 are each formed with an internal longitudinal passage adapted to be placed in communication with a source of liquefied gas to be vaporized and provided with equally spaced orifices (not shown in FIGS. 1 and 2) communicating with adjacent channels(s). One such spray bar 14 having a longitudinal passage 18 communicating with spray orifices 20 is shown in FIGS. 3A and 3B. The orifice 20 in the spacer bar 12 and the spray bar 14 is appropriately located and oriented to direct liquid towards the adjacent heat transfer surfaces of walls 4 which partially define the channel(s) 16. The passages 18 are adapted to be placed in communication by, for example, a pump (not shown) with a reservoir of liquefied gas to be boiled.

The condensing passages 8 are each provided with fins 22 in a manner well known in the heat exchange art. The fins increase the heat transfer surface available for the condensation of the vapor that is fed to the condensing passages 8.

In operation, a condenser-reboiler as shown in the drawings may operate with a condensing temperature in the order of 1° Celsius higher than the vaporization temperature of the liquefied gas to be boiled. In a condenser-reboiler for use in a double air separation column, the array of plates 4 is typically such that the condenser-reboiler is 1.2 meters square and 2 meters high. The distance between each pair of adjacent plates may typically be 6 mm and between adjacent channels 2.5 mm. The distance between adjacent orifices in each spray bar 14 may be 100 mm.

In operation, liquid oxygen is sprayed under pressure into the channels 16 forming a thin falling film over the coated porous metal plate surfaces of the boiling passages 6. These surfaces are heated to above the boiling point of the oxygen by condensing nitrogen passing through the condensing passages 8. Accordingly, the liquid oxygen flashes to vapor, and oxygen vapor is withdrawn from the bottom portion of the boiling passages 6.

An alternative embodiment of the condenser-reboiler shown in FIGS. 1 to 3 has sPray orifices 20 only at the top of bars 14 and, additionally, at the top of spacer bars 12. In this embodiment, the sprayed liquefied gas creates a thin falling film over the porous surfaces of the boiling passages 6.

Figure 4:
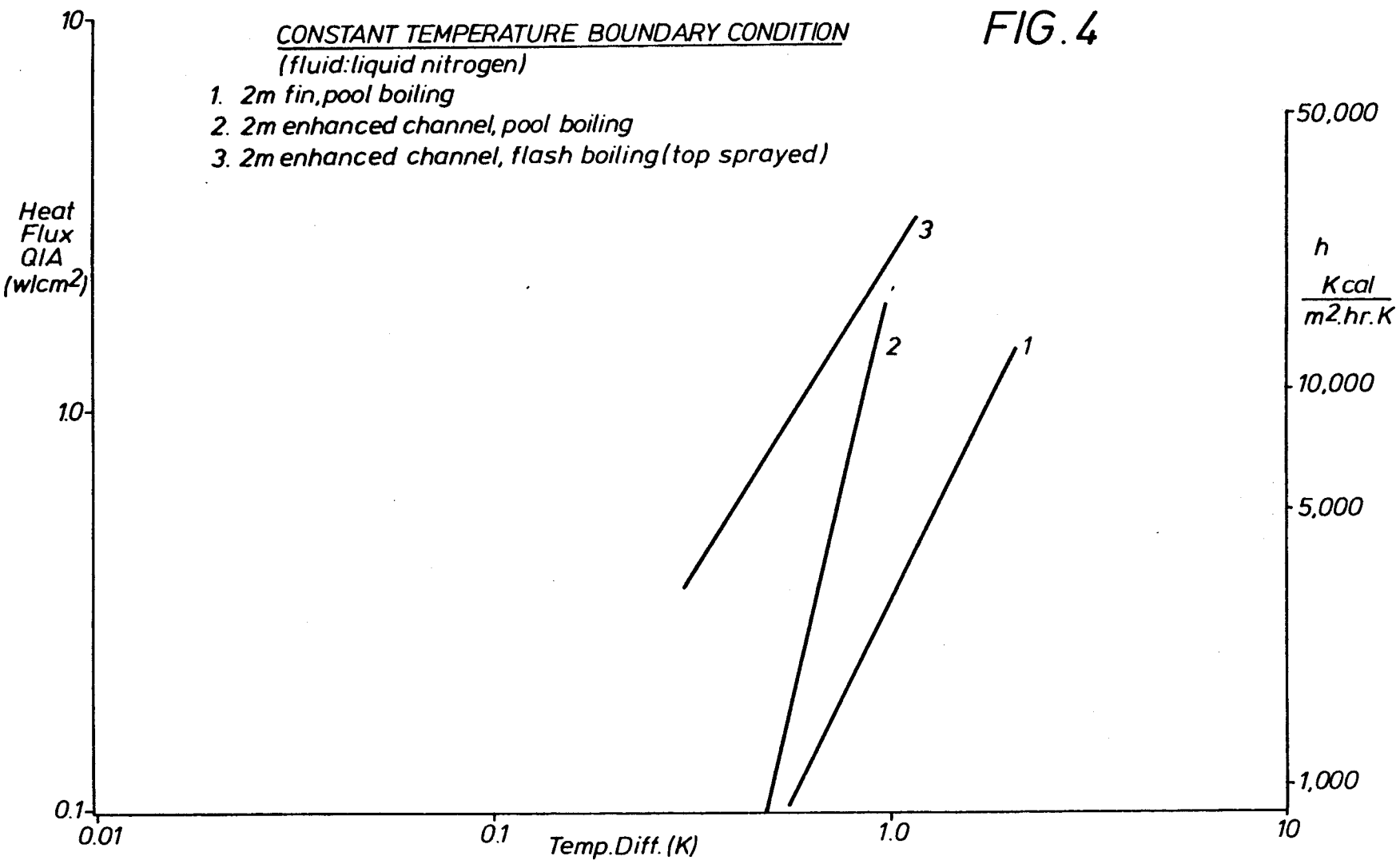
FIG. 4 is a graph illustrating the variation in Q/A (the heat flux) and h (the heat transfer coefficient) with delta T for different methods of boiling.

Referring now to FIG. 4, values of h, the boiling heat transfer coefficient, were measured under constant wall temperature for three heat exchange surfaces, each 2 m in length. The measurements were taken on a test rig representing one vertical heat exchange passage having a 50 mm wide box section. The rig was provided with copper constant thermocouples for measuring wall and channel temperatures at intervals of 10 cm along the length of the rig. Heat transfer measurements were made by measuring the difference between wall and channel for different electrical heater powers.

The first sample tested, line 1 in FIG. 4, comprised a finned, polished, aluminum surface totally immersed in a pool of liquid nitrogen at atmospheric pressure.

The second and third samples tested, lines 2 and 3, respectively, in FIG. 4, each comprised an aluminum surface bearing a porous aluminum surface formed by plasma spraying the surface with a proprietary mixture of a silicon-aluminum alloy and polyester powder (Metco 601 NS) and subsequently volatilizing the polyester by heating for 2 hours at 540° C. The deposited coating had a thickness of 0.25 mm. The second sample was tested when totally immersed in a pool of liquid nitrogen at atmospheric pressure, while the third sample was tested by spraying liquid nitrogen into the top of the rig from a nozzle passing through a closure at the top of the rig, vaporized nitrogen exiting the test section at its bottom.

The results obtained show that, up to a temperature difference of about 1K, boiling of a falling film of liquid nitrogen gives higher values of the boiling heat transfer coefficient h (and the heat flux Q/A) than conventional pool boiling irrespective of whether the pool boiling is assisted by use of an enhanced heat transfer surface or not.

Figure 5:
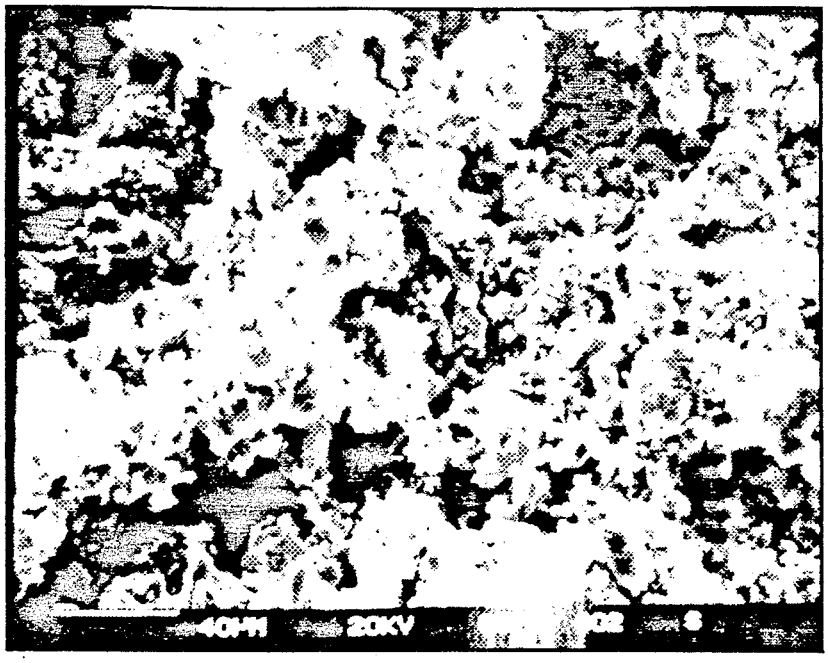
FIG. 5 is an electronmicrograph of the surface of a heat transfer member suitable for use in a liquefied gas boiler according to the invention, showing the surface at a magnification of 500 times actual size.
Figure 6:
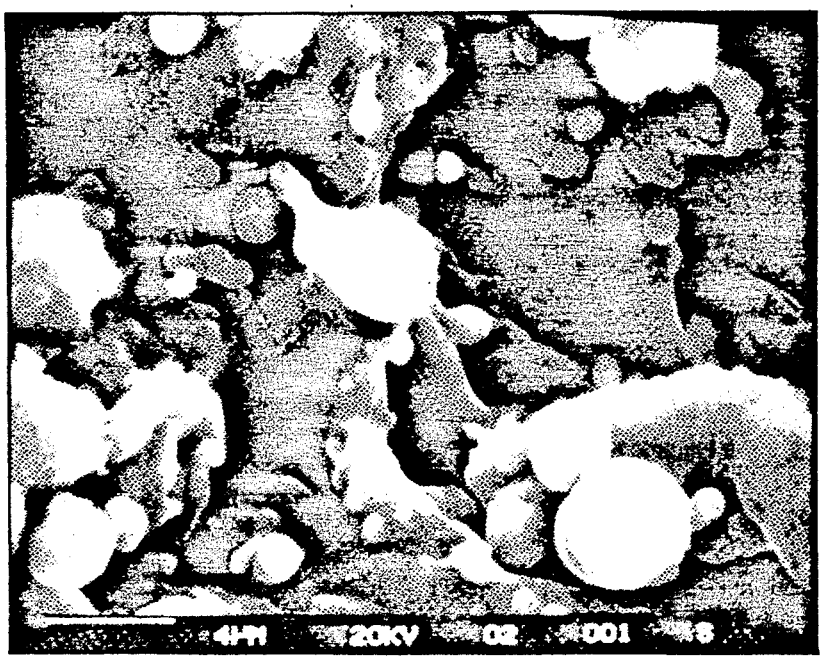
FIG. 6 is an electronmicrograph similar to FIG. 5 but at a magnification of 5000 times actual size.

FIGS. 5 and 6 are electronmicrographs of a heat transfer surface formed by plasma spraying a particulate mixture of, by mass, 60% of aluminum and 40% of polyester onto an aluminum substrate and then baking the resultant coated substrate for two hours at 500° C. The coating had a thickness of 0.38 mm. FIG. 5 shows the coated surface at a magnification of 500 times actual size and FIG. 6 shows the surface at a magnification of 5000 times actual size. The resulting heat transfer surface may advantageously be employed to boil liquefied gas in accordance with the present invention.

We claim:

1. A boiler for liquefied gas comprising at least one heat transfer surface having an upper end and a lower end, means for creating a falling film of liquefied gas down the surface, means for heating the surface above the temperature at which the liquefied gas boils at the prevailing pressure, including a plurality of spaced, parallel, thermally conductive plates which define alternate passages for said liquefied gas and for fluid for heating the heat transfer surface present on the boiling side of the conductive plates, wherein each liquefied gas passage has a plurality of cooperating spacer members dividing said passage into three or more vertical channels, wherein each spacer member contains a plurality of spray orifices adapted to direct said liquefied gas at an associated heat transfer surface or surfaces, the orifices being in communication with a source of the liquefied gas, wherein said heat transfer surface has a multiplicity of non-regular interconnected vapor bubble nucleation sites.

2. A boiler in accordance with claim 1, wherein said heat transfer surface comprises porous metal.

3. A boiler in accordance with claim 2, wherein the metal is selected from the group consisting of copper, aluminum, and their alloys.

4. A boiler in accordance with claim 1, wherein vapor evolved from the boiling liquid is constrained to flow over said surface covered by the falling film in the same direction as said film.

* * * * *